United States Patent [19]

Richeson et al.

[11] Patent Number: 4,875,441

[45] Date of Patent: Oct. 24, 1989

[54] ENHANCED EFFICIENCY VALVE ACTUATOR

[75] Inventors: William E. Richeson; Frederick L. Erickson, both of Fort Wayne, Ind.

[73] Assignee: Magnavox Government and Industrial Electronics Company, Fort Wayne, Ind.

[21] Appl. No.: 294,728

[22] Filed: Jan. 6, 1989

[51] Int. Cl.[4] ..... F01L 9/02

[52] U.S. Cl. ..... 123/90.13; 123/90.14; 137/625.64

[58] Field of Search ..... 123/90.11, 90.12, 90.13, 123/90.14; 91/465; 137/625.66, 625.64

[56] References Cited

U.S. PATENT DOCUMENTS

| | | | |
|---|---|---|---|
| 2,552,960 | 5/1951 | Grieshaber et al. | 123/90.14 |
| 3,727,595 | 4/1973 | Links | 123/90.12 |
| 3,738,337 | 6/1973 | Massie | 123/90.12 |
| 4,074,699 | 2/1978 | Stampfli | 137/625.64 |
| 4,257,573 | 3/1981 | Stampfli | 137/625.64 |
| 4,604,197 | 8/1986 | Casey et al. | 137/625.64 |

FOREIGN PATENT DOCUMENTS 2804771 8/1978 Fed. Rep. of Germany ... 123/90.14

*Primary Examiner*—Charles J. Myhre
*Assistant Examiner*—Weilun Lo
*Attorney, Agent, or Firm*—Roger M. Rickert; Thomas A. Briody; Richard T. Seeger

[57] ABSTRACT

A bistable electronically controlled fluid powered valve actuator for use in an internal combustion engine of the type having engine intake and exhaust valves has a piston reciprocative in a cylinder housing for driving the engine valves to open and close. Control valves are mounted separately from the piston for reciprocative movement in the housing and are used to selectively direct air pressure to drive the piston. The control valves are magnetically latched in closed positions with the magnet force used to also close ends of the valves. Abutments are affixed to ends of the piston shaft to aid the control valves in their closing movements, especially if the valves have a transitory retardation; another aid to valve closing movement is the capture of air in a chamber that is sealed on opening valve movement so that the compression of air in the chamber acts as an air spring to aid in the valve closing movements.

23 Claims, 10 Drawing Sheets

ENHANCED EFFICIENCY VALVE ACTUATOR

SUMMARY OF INVENTION

The present invention relates generally to a two position, straight line motion actuator and more particularly to a fast acting actuator which utilizes pneumatic energy against a piston to perform extremely fast transit times between the two positions. The invention utilizes a pair of control valves to gate high pressure air to the piston and latching magnets to hold the valves in their closed positions until a timed short term electrical energy pulse excites a coil around a magnet to partially neutralize the magnet's holding force and release the associated valve to move in response to high pressure air to an open position. Pressurized pneumatic gases accelerate the piston rapidly from one position to the other position.

This actuator finds particular utility in opening and closing the gas exchange, i.e., intake or exhaust, valves of an otherwise conventional internal combustion engine. Due to its fast acting trait, the valves may be moved between full open and full closed positions almost immediately rather than gradually as is characteristic of cam actuated valves.

The actuator mechanism may find numerous other applications such as in compressor valving and valving in other hydraulic or pneumatic devices, or as a fast acting control valve for fluidic actuators or mechanical actuators where fast controlled action is required such as moving items in a production line environment.

Internal combustion engine valves are almost universally of a poppet type which are spring loaded toward a valve-closed position and opened against that spring bias by a cam on a rotating cam shaft with the cam shaft being synchronized with the engine crankshaft to achieve opening and closing at fixed preferred times in the engine cycle. This fixed timing is a compromise between the timing best suited for high engine speed and the timing best suited to lower speeds or engine idling speed.

The prior art has recognized numerous advantages which might be achieved by replacing such cam actuated valve arrangements with other types of valve opening mechanism which could be controlled in their opening and closing as a function of engine speed as well as engine crankshaft angular position or other engine parameters.

In copending application Ser. No. 021,195 entitled ELECTROMAGNETIC VALVE ACTUATOR, filed Mar. 3, 1987 in the name of William E. Richeson and assigned to the assignee of the present application, there is disclosed a valve actuator which has permanent magnet latching at the open and closed positions. Electromagnetic repulsion may be employed to cause the valve to move from one position to the other. Several damping and energy recovery schemes are also included.

In copending application Ser. No. 153,257 entitled PNEUMATIC ELECTRONIC VALVE ACTUATOR, filed Feb. 8, 1988 in the names of William E. Richeson and Frederick L. Erickson there is disclosed a somewhat similar valve actuating device which employs a release type mechanism rather than a repulsion scheme as in the previously identified copending application. The disclosed device in this application is a truly pneumatically powered valve with high pressure air supply and control valving to use the air for both damping and as the primary motive force. This copending application also discloses different operating modes including delayed intake valve closure and a six stroke cycle mode of operation.

Other related applications all assigned to the assignee of the present invention and filed in the name of William E. Richeson on Feb. 8, 1988 are Ser. No. 153,262 POTENTIAL-MAGNETIC ENERGY DRIVEN VALVE MECHANISM where energy is stored from one valve motion to power the next, and Ser. No. 153,154, filed on Feb. 8, 1988 REPULSION ACTUATED POTENTIAL ENERGY DRIVEN VALVE MECHANISM wherein a spring (or pneumatic equivalent) functions both as a damping device and as an energy storage device ready to supply part of the accelerating force to aid the next transition from one position to the other. One distinguishing feature of the REPULSION ACTUATED POTENTIAL ENERGY DRIVEN VALVE MECHANISM application is the fact that initial accelerating force is partly due to electromagnetic repulsion somewhat like that employed in the first above mentioned copending application.

In copending application Ser. No. 153,155 filed Feb. 8, 1988, in the names of William E. Richeson and Frederick L. Erickson, assigned to the assignee of the present application and entitled PNEUMATICALLY POWERED VALVE ACTUATOR, there is disclosed a valve actuating device generally similar in overall operation to the present invention. One feature of this application is that control valves and latching plates have been separated from the primary working piston to provide both lower latching forces and reduced mass resulting in faster operating speeds. This concept is incorporated in the present invention and it is one object of the present invention to further improve these two aspects of operation.

In Applicants' Ser. No. 294,730 filed in the names of Richeson and Erickson on even date herewith and entitled AIR POWERED VALVE ACTUATOR, the reciprocating piston of a pneumatically driven valve actuator has several air passing bores extending in its direction of reciprocation for providing an effective and efficient source of low or atmospheric air pressure at the opposite ends of the piston. The piston also has an undercut which, at the appropriate time, passes high pressure air to the back side of the air control valve thereby aiding in closing the control valve. The result is a higher air pressure closing the control valve than the air pressure used to open the control valve.

In Applicants' Ser. No. 295,177 filed in the names of Richeson and Erickson on even date herewith and entitled FAST ACTING VALVE there is disclosed a valve actuating mechanism having a pair of auxiliary pistons which aid in reclosing air control valves while at the same time damping main piston motion near the end of the mechanism travel.

In Applicants' Ser. No. 294,727 filed in the names of Richeson and Erickson on even date herewith and entitled PNEUMATIC ACTUATOR, an actuator has one-way pressure relief valves similar to the relief valves in the above mentioned Ser. No. 209,279 to vent captured air back to the high pressure source. The actuator also has "windows" or venting valve undercuts in the main piston shaft which are of reduced size as compared to the windows in other of the cases filed on even date herewith resulting in a higher compression ratio. The actuator of this application increases the area which is pressurized when the air control valve closes thereby still further reducing the magnetic force required.

In Applicant's Ser. No. 294,729 filed in the name of William E. Richeson on even date herewith and entitled ELECTRO-PNEUMATIC ACTUATOR, an actuator which reduces the air demand on the high pressure air source by recovering as much as possible on the air which is compressed during damping. The main piston provides a portion of the magnetic circuit which holds the air control valves closed. When a control valve is opened, the control valve and the main piston both move and the reluctance of the magnetic circuit increases dramatically and the magnetic force on the control valve is correspondingly reduced.

In Applicants' Ser. No. 295,178 filed in the names of Richeson and Erickson on even date herewith and entitled COMPACT VALVE ACTUATOR, the valve actuator cover provides a simplified air return path for low pressure air and a variety of new air venting paths allow use of much larger high pressure air accumulators close to the working piston.

All of the above noted cases filed on even date herewith have a main or working piston which drives the engine valve and which is, in turn powered by compressed air. The power or working piston is separated from the latching components and certain control valving structures so that the mass to be moved is materially reduced allowing very rapid operation. Latching and release forces are also reduced. Those valving components which have been separated from the main piston need not travel the full length of the piston stroke, leading to some improvement in efficiency. Compressed air is supplied to the working piston by a pair of control valves with that compressed air driving the piston from one position to another as well as typically holding the piston in a given position until a control valve is again actuated. The control valves are held closed by permanent magnets and opened by an electrical pulse in a coil near the permanent magnet. All of the cases employ "windows" which are cupped out or recessed regions on the order of 0.1 inches in depth along a somewhat enlarged portion of the shaft of the main piston, for passing air from one region or chamber to another or to a low pressure air outlet. These cases may also employ a slot centrally located within the piston cylinder for supplying an intermediate latching air pressure as in the above noted Ser. No. 153,155 and a reed valve arrangement for returning air compressed during piston damping to the high pressure air source as in the above noted Ser. No. 209,279.

The entire disclosures of all of the above identified copending applications are specifically incorporated herein by reference.

In the present invention, the power or working piston which moves the engine valve between open and closed positions is separated from the latching components and certain control valving structures so that the mass to be moved is materially reduced allowing much faster operation as explained in Ser. No. 153,155. Latching and release forces are also reduced by balancing the pneumatic pressures on opposite sides of the control valve, and transferring kinetic energy from the damping of the power piston to accelerating the control valve towards its closed and latched position.

Among the several objects of the present invention may be noted the provision of a bistable fluid powered actuating device characterized by extremely fast transition times and economy of size, manufacture and power requirements; the provision of a pneumatically powered valve actuator where the control valves within the actuator cooperate with, but operate separately from the main working piston and are urged to a latched or closed position through kinetic energy transfer from piston dampening; and the provision in combination therewith of balanced pneumatic pressure on opposite sides of the control valve during latching or closing whereby the latching magnets are reduced in size and cost and required power to operate the valve. These as well as other objects and advantageous features of the present invention will be in part apparent and in part pointed out hereinafter.

In general, a bistable electronically controlled fluid powered transducer has an air powered piston which is reciprocable along an axis between first and second positions along with a control valve reciprocable along the same axis between open and closed positions. A magnetic latching arrangement functions to hold or latch the control valve in the closed position while an electromagnetic arrangement may be energized to temporarily weaken the effect of the permanent magnet latching arrangement to release the control valve to move from the closed position to the open position under pneumatic force. Energization of the electromagnetic arrangement causes movement of the control valve in one direction along the axis allowing fluid from a high pressure source to drive the piston in the opposite direction from the first position to the second position along the axis. The distance between the first and second positions of the piston is typically greater than the distance between the open and closed positions of the valve.

Also in general and in one form of the invention, a pneumatically powered valve actuator includes a valve actuator housing with a piston reciprocable inside the housing along an axis. The piston has a pair of oppositely facing primary working surfaces.

A pair of air control valves are reciprocative along the same axis between open and closed positions. A coil formed about a latching permanent magnet is pulsed to temporarily weaken the permanent magnet thus unlatching its respective air control valve. The control valve has one surface subject to a fluid pressure to move the valve toward its open position. Movement of the control valve after unlatching introduces fluid pressure to a primary working surface of the piston to move the piston toward its second position. Movement of the piston, in turn, introduces fluid pressure to a control valve surface opposite to the one surface to effectively balance fluid pressure across the control valve and significantly reduce the force required by the permanent magnet to reclose the control valve.

In addition, as the piston continues to move towards its second position, an abutment on the piston shaft engages the control valve aiding in its reclosing and latching movement. This further significantly reduces the required reclosing force and the size and cost of the latching permanent magnet and the neutralizing coil, and the power required by the coil.

Another feature of this invention is the provision of a pair of annular chambers that communicate with a low pressure source when their respective air valves are in a closed position but which become sealed from the source as the valves move to their respective open positions. The air in the sealed chambers is compressed as the air valves move to their open positions and thus acts as an air return spring to close the valves, again reducing the size and required strengths of the permanent latching magnet and electromagnetic neutralizing coil and its power requirement.

Also disclosed in this application, and as more fully disclosed in the above referenced copending application Ser. No. 153,155, there is an air vent located about midway between the extreme positions of piston reciprocation for dumping expanded air from the one primary working surface and removing the accelerating force from the piston. The air vent also functions to introduce air at an intermediate pressure to be captured and compressed by the opposite primary working surface of the piston to slow piston motion as it nears one of the extreme positions and the air vent supplies intermediate pressure air to one primary working surface of the piston to temporarily hold the piston in one of its extreme positions pending the next opening of an air control valve. The air control valve is uniquely effective to vent air from the piston for but a short time interval after damping near the end of a piston stroke while supplying air to power the piston during a much longer time interval earlier in the stroke.

BRIEF DESCRIPTION OF THE DRAWING

Corresponding reference characters indicate corresponding parts throughout the several views of the drawing.

Figure 1:
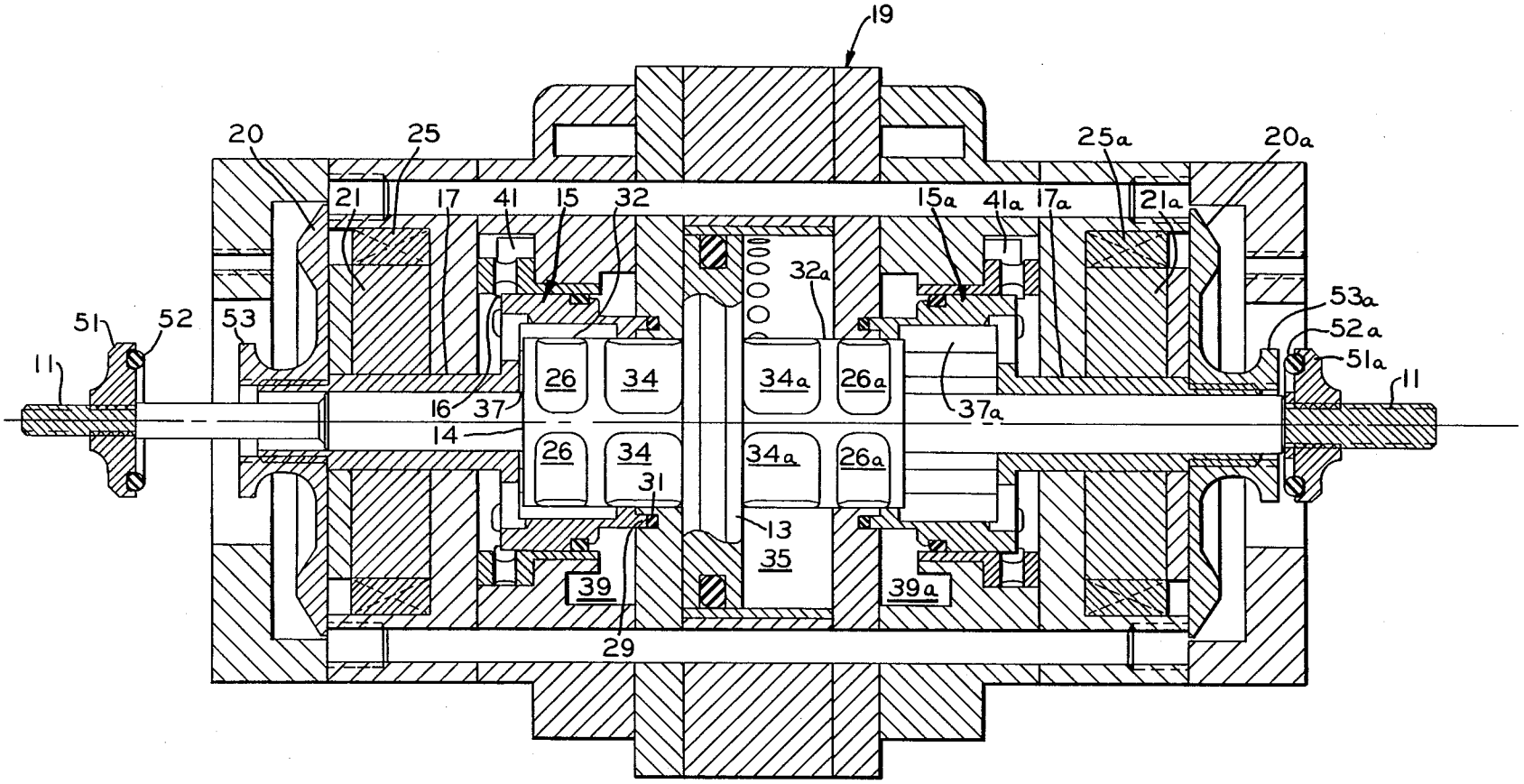
FIG. 1 is a view in cross-section showing the pneumatically powered actuator of the present invention with the power piston latched in its leftmost position as it would normally be when the corresponding engine valve is closed.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

The valve actuator is illustrated sequentially in FIGS. 1–8 to illustrate various component locations and functions in moving a poppet valve or other component (not shown) from a closed to an open position. Motion in the opposite direction although not described will be clearly understood from the symmetry of the components. Symmetrical components on the right side of the Figures are assigned the same reference numeral as corresponding components on the left side, with the exception that the reference numerals have the suffix "a." The actuator includes a shaft or stem 11 which may form a part of or connect to an internal combustion engine poppet valve. The actuator also includes a low mass reciprocable piston 13 carrying an o-ring, and a pair of reciprocating or sliding control valve members 15 and **15*a* enclosed within a housing 19. The control valve members 15 and 15*a* are latched in one position by permanent magnets 21 and 21*a* respectively and may be dislodged from their respective latched positions by pulse energization of coils 25 and 25*a* from a pulse source not shown but synchronized with piston movement. Valves 15, 15*a* each comprise annular bodies having elongated tubular shafts, 17, 17*a* respectively. The permanent magnet latching arrangement also includes iron pole pieces or armatures 20 and 20*a*. The control valve members or shuttle valves 15 and 15*a* cooperate with both the piston 13 and the housing 19 to achieve the various porting functions during operation. The housing 19 has a high pressure annular cavity 39 fed by pump, not shown, and a low pressure cavity 41** which is relieved to atmosphere. The low pressure may be about atmospheric pressure while the high pressure is on the order of 100 psi gauge pressure or pressure above atmospheric pressure.

FIG. 1 shows an initial state with piston 13 in the extreme leftward position and with the air control valve 15 latched closed. In this state, the annular ring 29 of valve 15 is seated in an annular slot in the housing 19 and seals against an o-ring 31. This seals the pressure in cavity 39 and prevents the application of any moving force to the main piston 13. In this position, the main piston 13 is being urged to the left (latched) by the pressure in cavity or chamber 35 which is greater than the pressure in annular chamber or cavity 41 which, in FIG. 1., communicates with surface 14 of recessed body 32 through annular passage 16. In the position illustrated, annular opening 16 is in its final open position after having released compressed air from annular cavity 37 at the end of a previous leftward piston stroke. Cavities 37, **37*a* are fluted to provide bearing surfaces for the recessed bodies 32, 32*a* attached to and integral with piston 13**.

Figure 2:
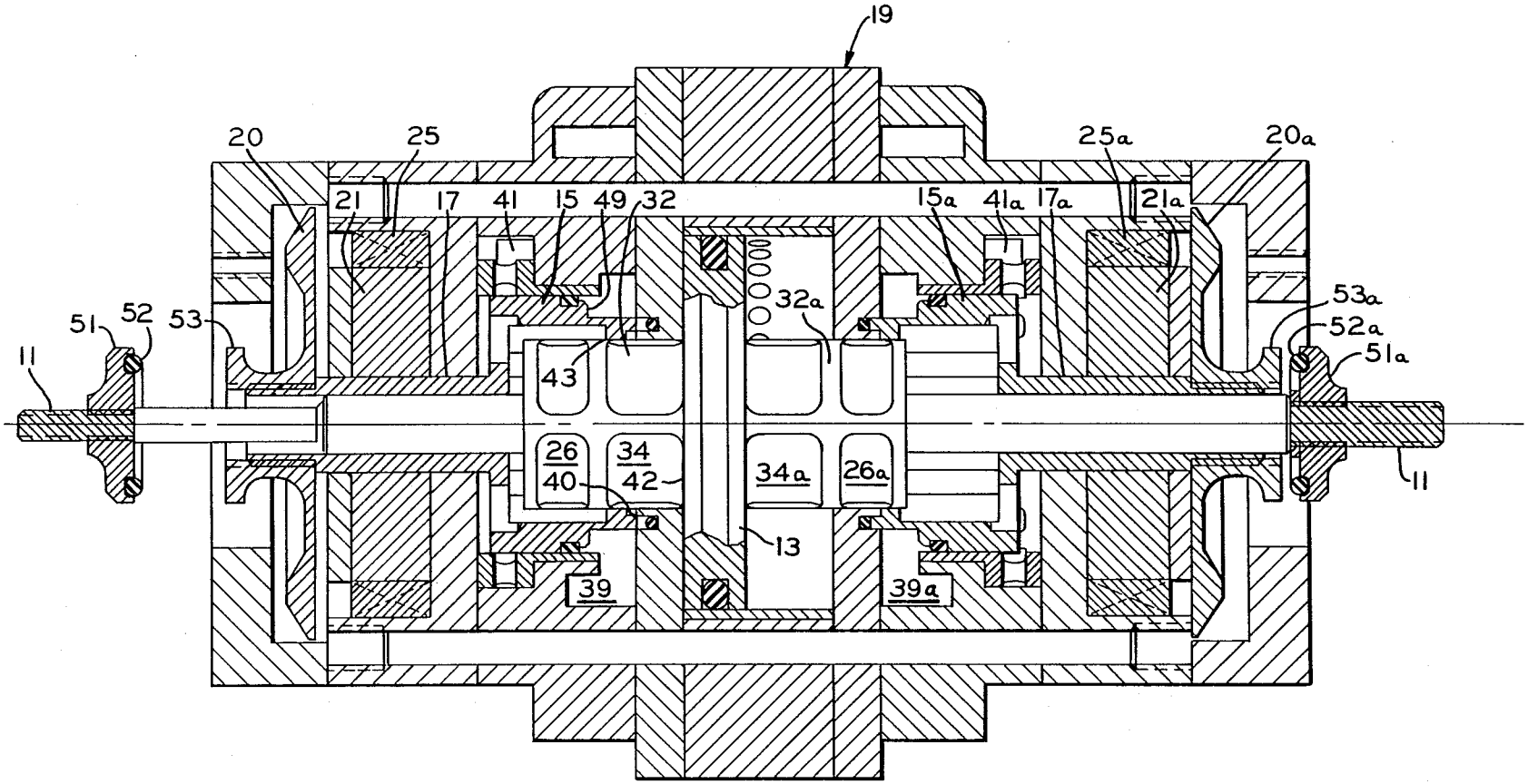
FIGS. 2–6 are views in cross-section similar to FIG. 1, but illustrating component motion and function as the piston progresses rightwardly to its extreme rightward or valve open position of a first embodiment of this invention.

In FIG. 2, the shuttle valve 15 has moved toward the left, for example, 0.060 in. while piston 13 has not yet moved and air at a high pressure now enters shallow recesses or "windows" 34, of which there are four equally spaced about body 32, from cavity 39 applying a motive force to the left face 42 of piston 13. The air valve 15 has opened because of an electrical pulse applied to coil 25 which has temporarily neutralized or weakened the holding force on iron armature or plate 20 by permanent magnet 21. Armature 20 is fixed to the end of valve 15. When that holding force is temporarily neutralized, air pressure in cavity 39 which is applied to the air pressure responsive annular face 49 of valve 15 causes the valve to open. Notice that the communication between cavity 37 and the low pressure outlet port 41 has been interrupted by movement of the valve 15 leftwardly with annular shoulder 24 of valve 15 cutting off fluid communication between low pressure cavity 41 and chamber 37. During this movement, chamber 37 is enlarged and just beginning to establish fluid communication between cavity 39 and face 42 across annular shoulder 40 of valve 15, to force piston 13 rightwardly.

It should be noted that ring 29 does not leave the annular slot in housing 19 until annular shoulder 43 registers with the edge of recesses 34 to fully pressurize recesses 34 and cavity 44. (FIG. 3)

Figure 3:
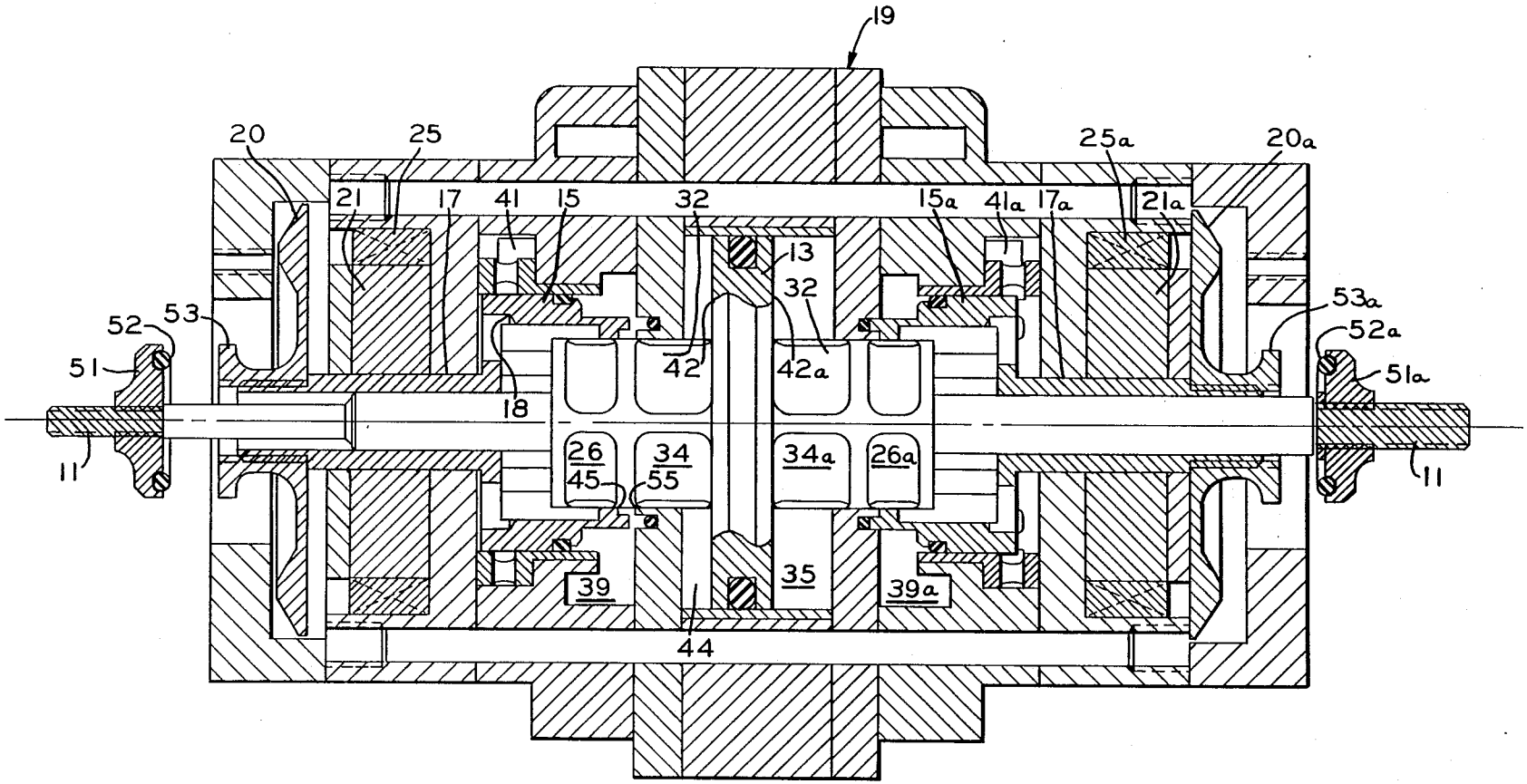

FIG. 3 shows the leftward movement or opening of the air valve 15 to about 0.110 in. (approximately wide open) and movement of the piston 13 about 0.140 in. to the right. In FIG. 2, the high pressure air supply was beginning to the cavity 37 and to the face 42 of piston 13 driving that piston toward the right. That high pressure air supply to cavity 44 is now cut off by the edge of recess 34 passing the annular shoulder 55 of the housing 19. Piston 13 continues rightwardly, however, due to the existing high pressure air in cavity 44. The relative movement between valve 15 and piston 13 has almost reached the point where annular shoulder 45 on valve 15 will open a fluid path between cavity 39 and chamber 37 through recesses 26 causing a high pressure on annular surface 18 of valve 15 and connected surfaces to substantially balance the axial pressures o valve 15.

Figure 4:
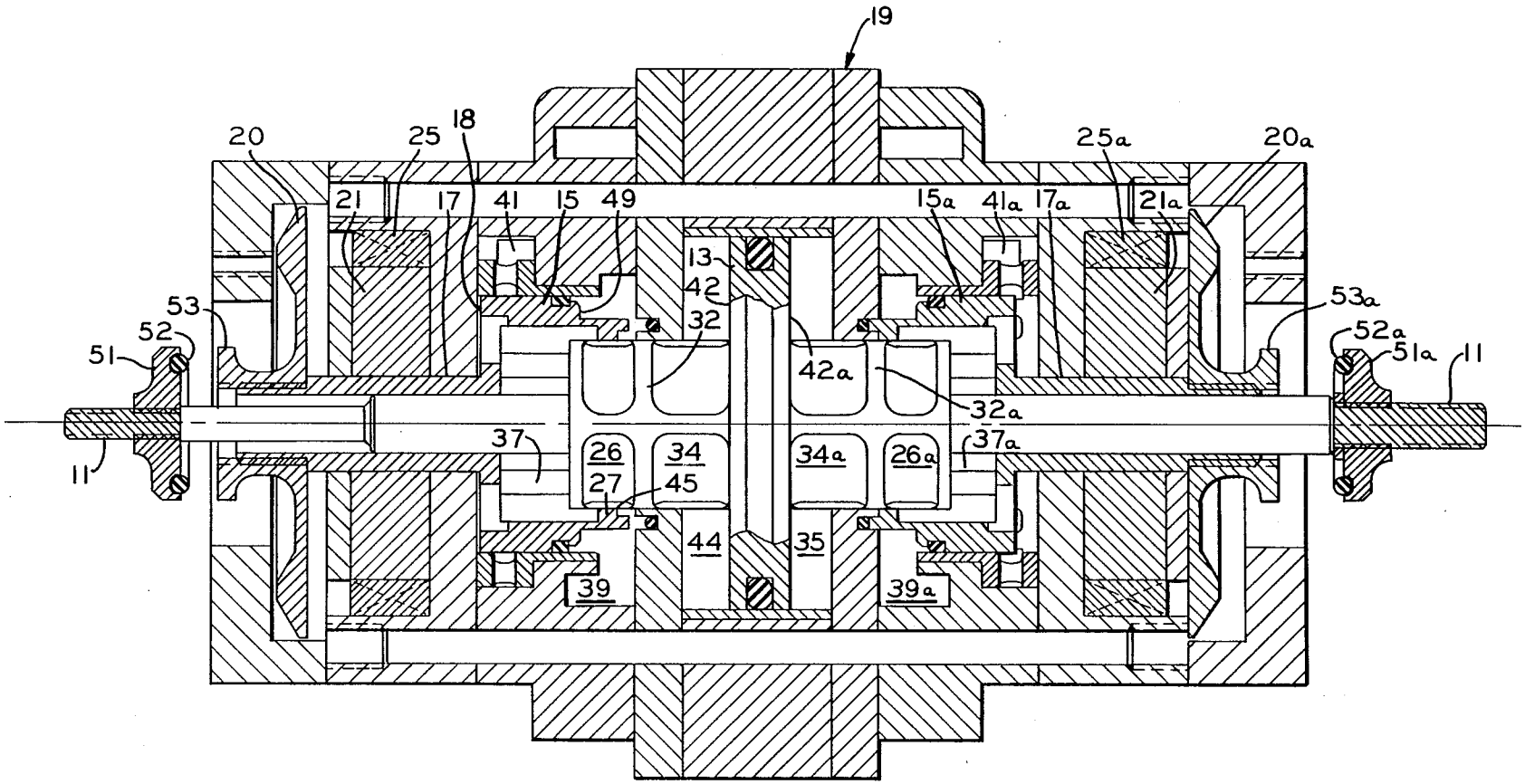

The piston 13 has moved approximately 0.240 inches and is continuing to move toward the right in FIG. 4 and the air valve 15 is still at 0.110 inches and has reached its maximum leftward open displacement. Shoulder 45 has fully cleared the associated edge of recess 26 to introduce pressure from cavity 39 to chamber 37 around annular land 27. The valve 15 will tend to remain in this position for a short time due to the continuing air pressure on the annular surface 49, and connected surfaces, from high pressure source 39. Equalization of the pressure across the air valve reduces the force required to return the air valve from its leftmost motion. Thus the magnetic attraction of the armature 20 by the permanent magnet 21 pulls the air valve 15 back toward its closed position. By venting the high pressure from source 39 through recesses 26, which are positioned aft of recesses 34, equalization of pressure on surfaces 18 and 49 is delayed until piston 13 is well advanced and there is no likelihood that valve 15 will prematurely close.

Figure 5:
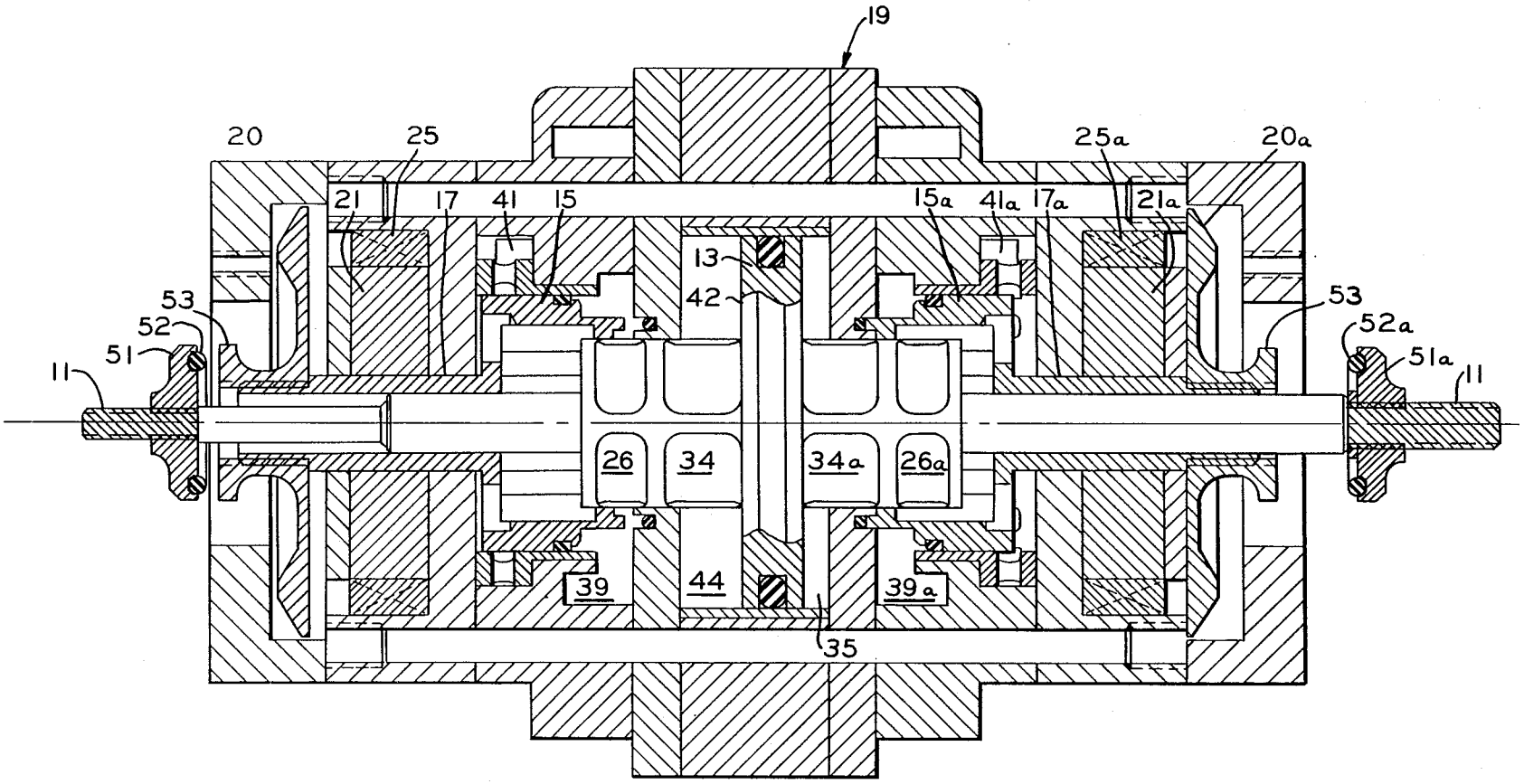

In FIG. 5, the air valve 15 is about, 0.080 inches from its closed position and is beginning to return to its closed position since all pressure around the valve has been neutralized and only the attractive force of magnet 21 on disk 20 is causing the disk to move back toward the magnetic latch. Piston 13 has moved about 0.340 inches in FIG. 5.

An intermediate pressure, such as 4 psi gauge, is introduced from intermediate ports 47 (FIG. 6) supplied by a source, not shown, into cavity 44 so that the high pressure air in chamber 44 has blown down to the intermediate pressure. This feature has also been disclosed in the above referenced application Ser. No. 153,155 which is incorporated herein by reference. Vents 47 dump expanded air from primary working surface 42 and remove the accelerating force from the piston. The vents 47 also function to introduce air at the intermediate pressure to be captured and compressed by the opposite primary working surface 42*a* of the piston to slow piston motion as it nears its second position and vents 47 supply intermediate pressure air to working surface 42 of the piston to temporarily hold the piston in its second position pending the next opening of air control valve 15*a*.

Figure 6:
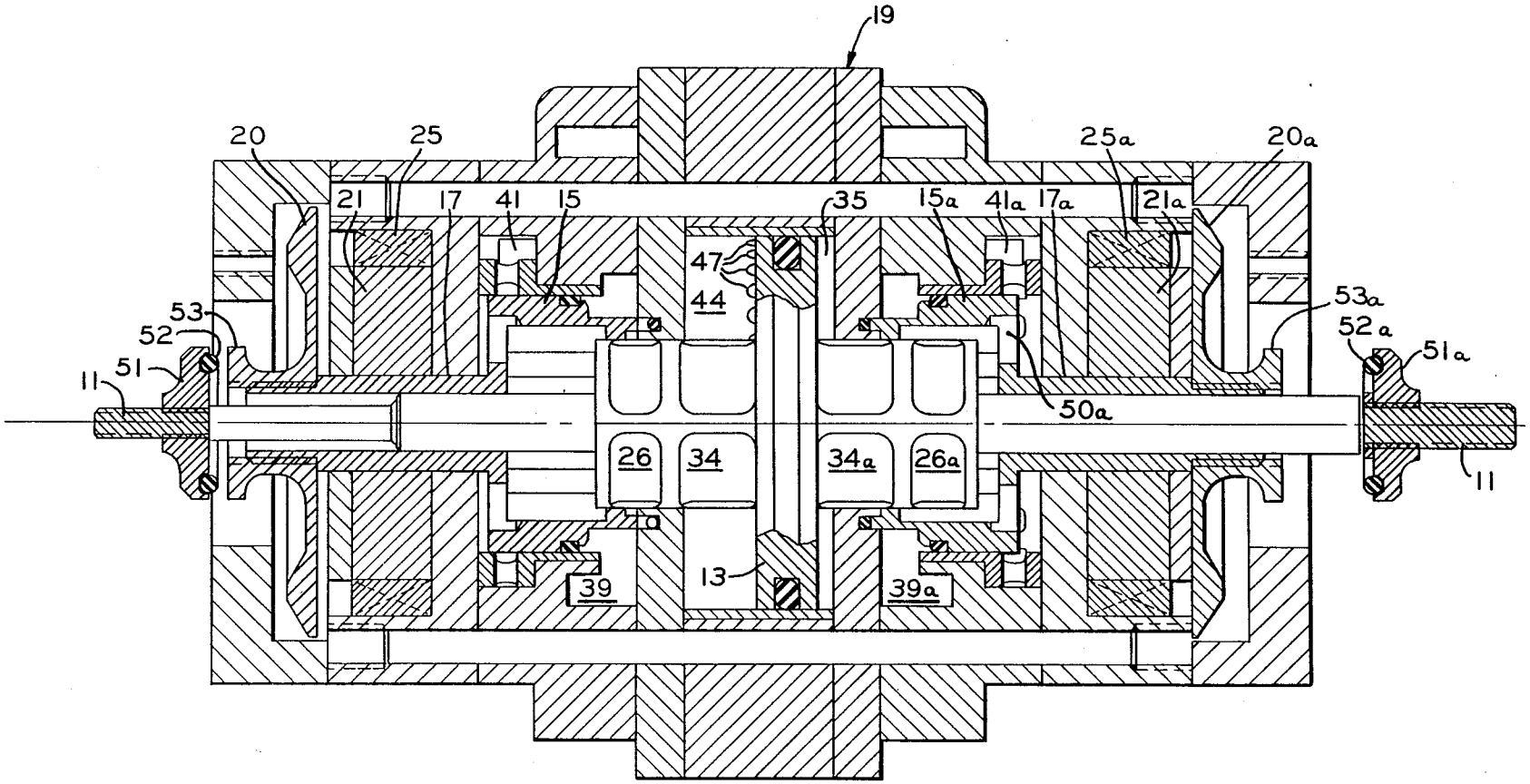

FIG. 6 illustrates air valves 15, 15*a* in their fully closed positions and piston 13 approaching its extreme rightward position, the highly pressurized air in chamber 35*a* being exhausted to atmosphere through recess 34*a*, cavity 50*a* and cavity 41*a*. Due to the aforementioned symmetry of valve construction, the movements of valve 15*a* and piston 13 is the mirror of the previously described operation of valve 15 and piston 13.

It will be understood from the symmetry of the valve actuator that the behavior of the air control valves 15 and 15*a* in this venting or blow-down is, as are many of the other features, substantially the same near each of the opposite extremes of the piston travel. These same components cooperate at the beginning of a stroke to supply air to power the piston for a much longer portion of the stroke.

Figure 7:
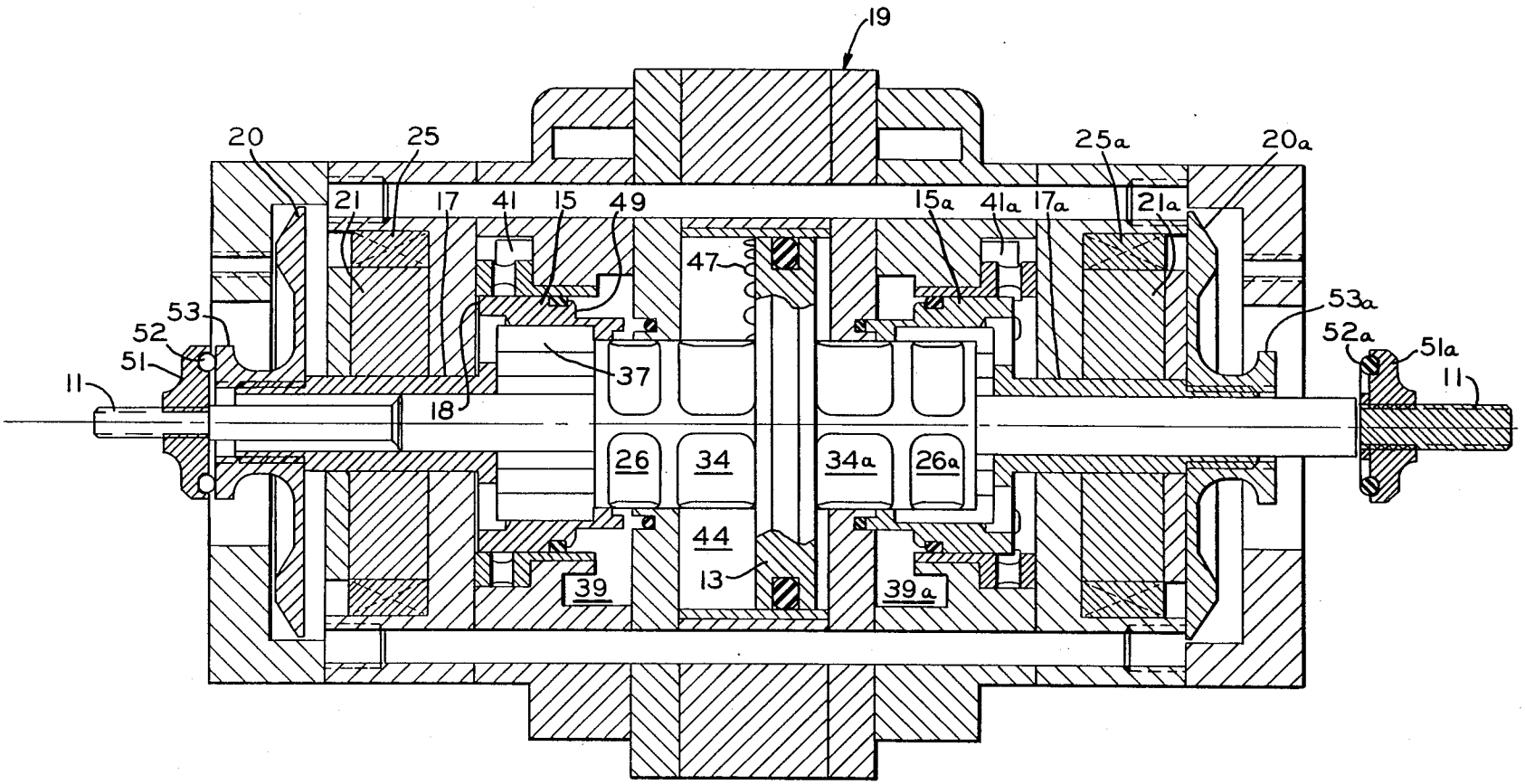
FIGS. 7 and 8 are views in cross-section similar to FIGS. 2–6 showing relative positions of the air valve and piston during a particular mode of operation of the embodiment of FIGS. 2–6.
Figure 8:
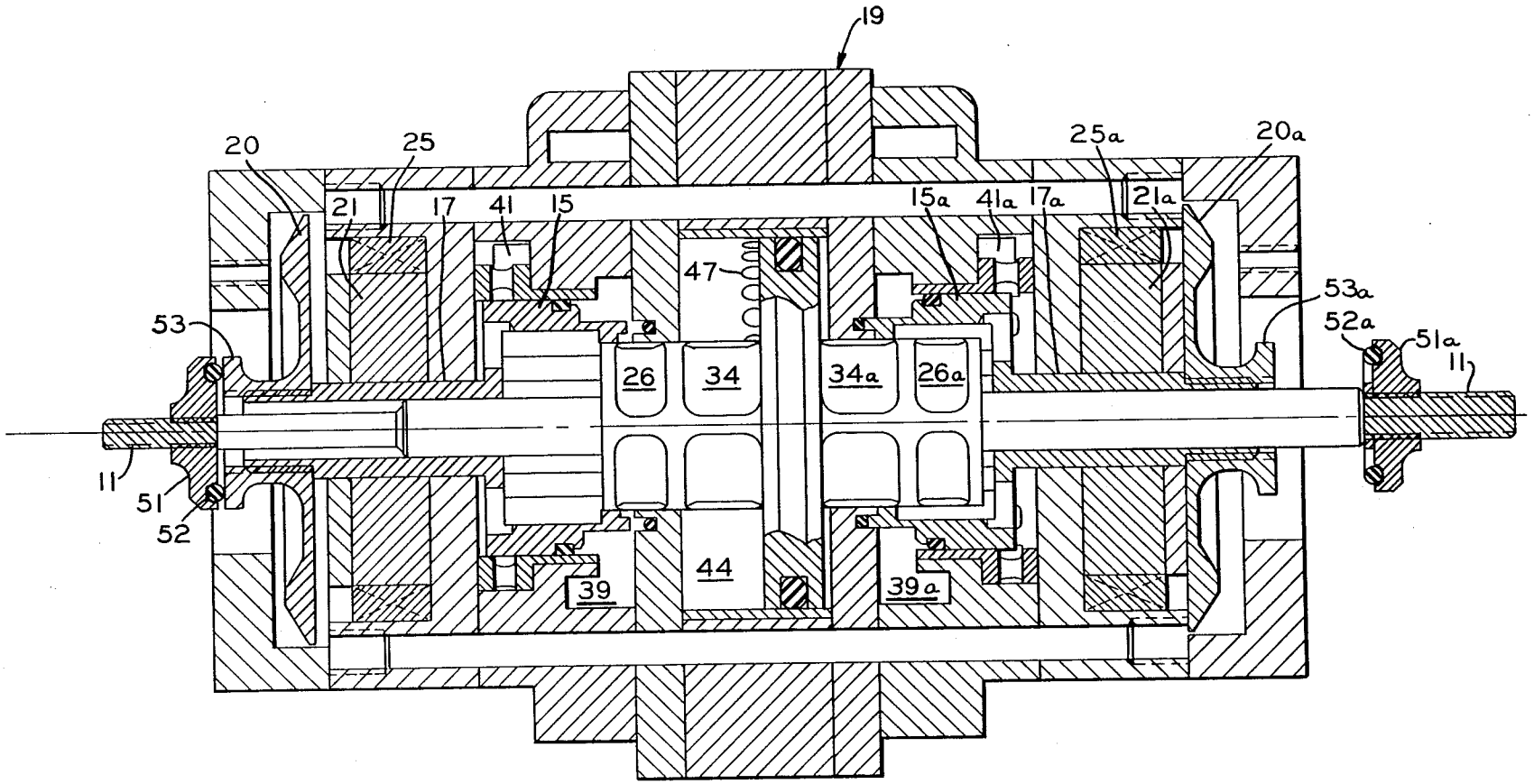

In FIGS. 7 and 8, an important feature of this invention is shown that insures closing of valve 15 even though there is some frictional, or other interference to valve movement and for an inadequate closing force from magnet 21. In FIG. 7 valve 15 is approximately in the position of FIG. 5 (fully open), the pressure in chamber 35 is increasing, and piston 13 has traveled 0.400 inches. The high pressure air from cavity 39 has been cut off from surface 18 and chamber 37 has expanded causing a pressure differential across valve 15 urging it to the open position. Due to frictional resistance and/or magnet 21 is of such reduced size and strength it is not strong enough to pull the armature closed against this pressure differential, valve 15 has not moved in a closing direction while piston 13 has continued in its movement.

Abutments 51, 51*a* are adjustably positioned on piston shaft 11 and carry o-rings 52, 52*a* on their respective inner surfaces that are in abutting relation to annular feet 53, 53*a* of armatures 20, 20*a* respectively when valves 15, 15*a* are fully open. Since piston 13 is moving rightwardly, abutment 51 will urge armature 20 rightwardly toward its closed position. As armature 20 approaches magnet 21, the magnet attraction increases geometrically so that even a reduced size and strength magnet 21 will provide adequate closing force of valve 15. Thus it is seen that abutment 51 aids in the closing of valve 15 but does not participate in the final closing movement. This reduces the wear and stress on the components. It should be remembered that reducing the size of magnets 21, 21*a* also reduces the required size of coils 25, 25*a* and their power requirements.

FIG. 8 illustrates valve 15 in an open position slightly closed from the FIG. 6 position, about 0.080 inches from the closed position, and a piston 13 travel of about 0.430 inches. Valve 15 continues under the influence of abutment 51 on foot 53 in its closing motion and since the magnetic force between magnet 21 and armature 20 is increasing geometrically as the separating distance decreases, valve 15 will close to the position shown in FIG. 6 under the magnetic attraction of magnet 21 only. It should be understood that it may be necessary to close valve 15 with the aid of abutment 51 during only a fraction of the operation duty cycle of the valves and then due to some abnormal interferences to valve operation.

Figure 9:
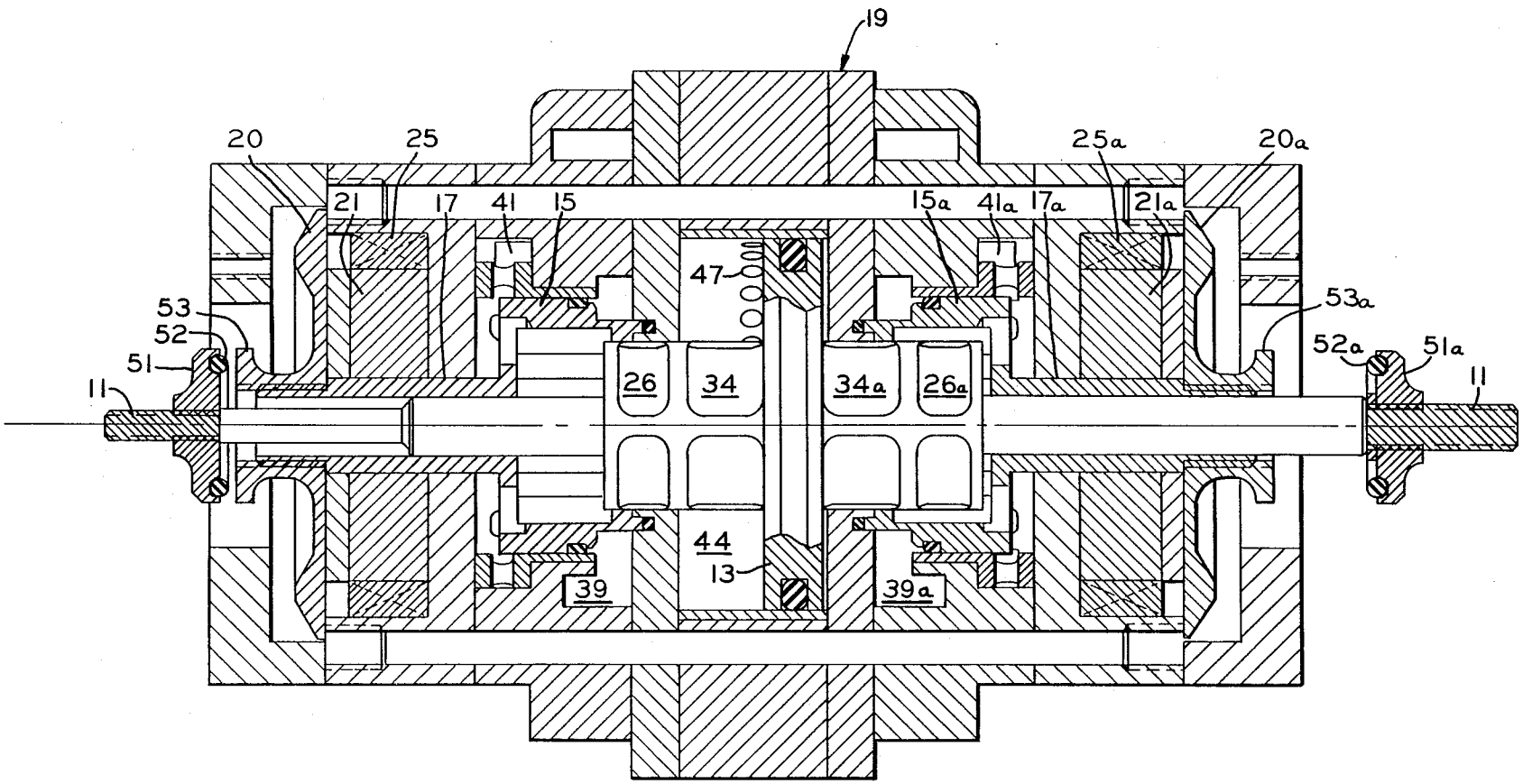
FIG. 9 is a view in cross section similar to FIGS. 2–8 and showing relative positions of the air valve and power piston of another embodiment of this invention.

FIG. 9 illustrates a second embodiment of this invention that is similar in all respects of construction and operation to that illustrated in FIGS. 1–8 except that magnets 21, 21*a* are larger and stronger so that it is less likely for abutments 51, 51*a* to become necessary to aid in closing valves 15, 15*a*, respectively. Magnets 21, 21*a* and coils 25, 25*a* while larger and stronger than those in the embodiment of FIGS. 1–8, are still smaller than might be otherwise necessary due to the aforementioned balancing of air pressures across valve 15.

Figure 10:
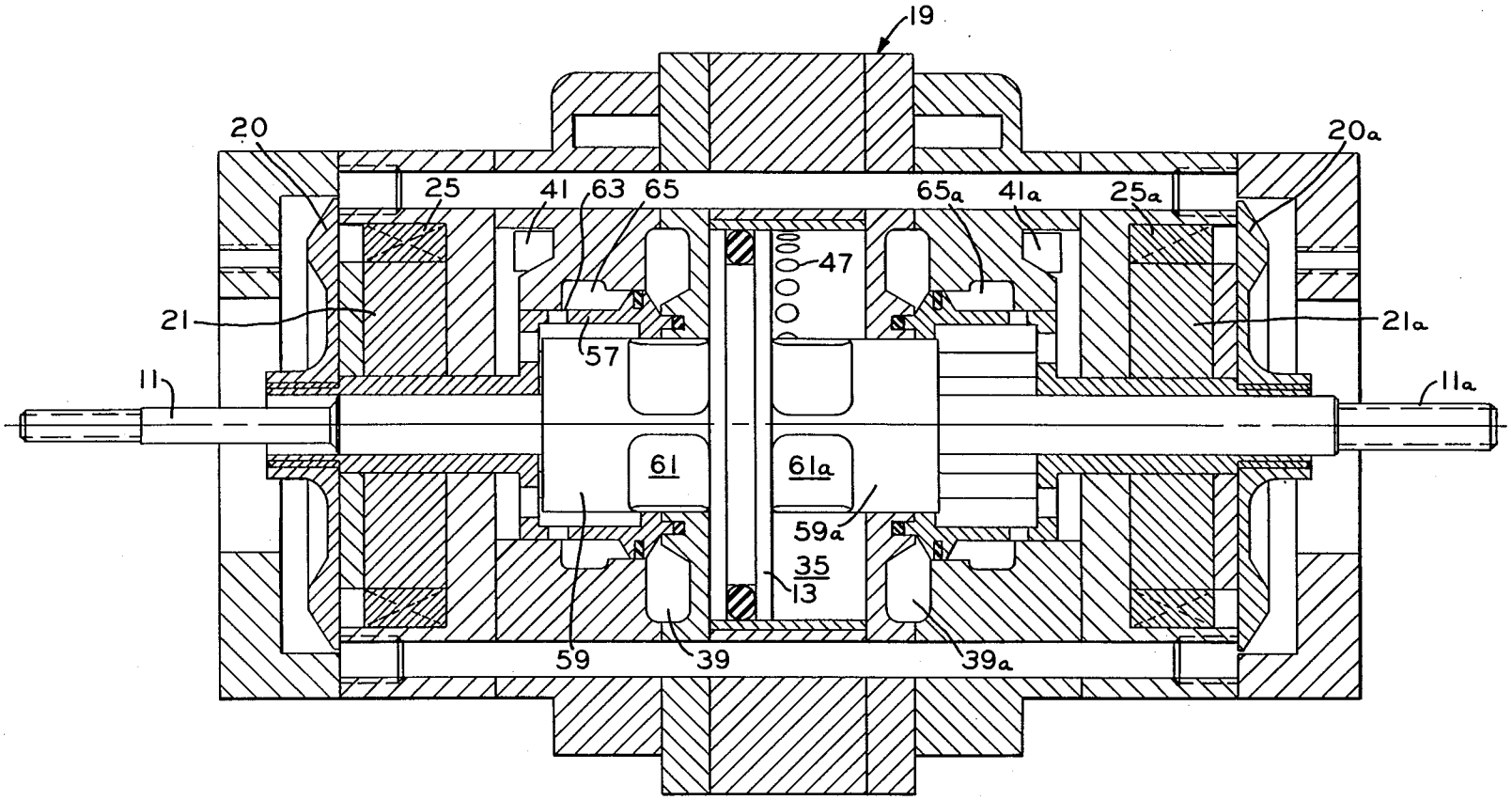
FIG. 10 is a cross-sectional view to FIG. 1 of a further embodiment of this invention.

FIG. 10 illustrates a further embodiment of this invention similar in operation and construction with similar components carrying similar reference numerals to the embodiment of FIG. 9 with the following differences. The primary difference is that air or control valve 57 in FIG. 10 instead of having balanced pneumatic pressures and/or an abutment on the piston shaft to aid in its closing (left to right) movement, a closed annular cavity is created on the opening movement of air valve in which the pneumatic pressure increases as the valve continues in its opening movement, thus providing an "air spring" to aid in the closing valve movement so that once again the size, strength and cost of magnet 21 is reduced with a corresponding reduction in coil 25 and the power required thereby.

Piston shaft 11 is integral with and carries recessed bodies 59, 59*a* each of which have four circumferentially equally spaced shallow recesses or windows 61, 61*a* respectively. It is noted there are no recesses corresponding to recesses 26, 26*a* in the earlier described embodiments since there is no balancing of pneumatic pressure on either side of annular valves 57, 57*a* to aid in the closing (movement towards piston 13) valve movement. Also it is noted that there are no abutments 51, 51*a* on shaft ends 11, 11*a* respectively.

Opening motion of air valve 57 (away from piston 13) closes annular vent passage 63 between annular cavity 65 and low pressure atmospheric annular cavity 41. Further opening movement of valve 57 will compress the air in cavity 65 and at the open valve 15 position (not shown) the compressed air in cavity 65 will act as an air spring to assist magnet 21 in the closing valve movement. The size and strength of magnet 21 and the compression in cavity 65 may be selected as desired. Also, abutments similar to abutments 51, 51*a* may be added if desired to shaft ends 11, 11*a* respectively to aid in closing valves 57, 57*a* respectively to further reduce the size and strengths of magnets 21, 21*a* and associated coils 25, 25*a* and the power supplied thereto.

Little has been said about the internal combustion engine environment in which this invention finds great utility. That environment may be much the same as disclosed in the abovementioned copending applications and the literature cited therein to which reference may be had for details of features such as electronic controls and air pressure sources. In this preferred environment, the mass of the actuating piston and its associated coupled engine valve is greatly reduced as compared to the prior devices. While the engine valve and piston move about 0.45 inches between fully open and fully closed positions, the control valves move only about 0.125 inches, therefor requiring less energy to operate. The air passageways in the present invention are generally large annular openings with little or no associated throttling losses.

From the foregoing, it is now apparent that a novel electronically controlled, pneumatically powered actuator has been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follow.

What is claimed is:

1. A bistable electronically controlled fluid powered transducer having a first member reciprocative in a housing along an axis between first and second positions;

a control valve reciprocative in said housing along said axis between open and closed positions and having first and second opposite surfaces;

magnetic latching means comprising a permanent magnet for closing and holding said control valve in its closed position;

electromagnetic means for temporarily neutralizing the effect of said magnetic latching means to release the control valve to move from the closed position towards the open position;

fluid pressure means comprising a fluid pressure source for providing fluid pressure to said valve to move said valve toward said open valve position against the holding force of said permanent magnet;

means to energize said electromagnetic means to provide an electric pulse to said electromagnetic means to temporarily neutralize the effect of said permanent magnet so that said control valve can move in said one direction under fluid pressure from said source;

each of said member and said valve having first and second opposite axial ends;

said member first axial end carrying a valve end engaging abutment for abutting said valve first axial end to urge said valve towards said closed position during travel of said member towards said first position thereby damping the motion of said first member and providing impetus to said valve towards said closed position.

2. The apparatus of claim 1 including first porting means in said housing cooperative with said first member and said valve for providing fluid communication between said source and one side of said first member to move said first member axially as said valve is moving between said closed and open positions;

second porting means in said housing cooperative with said first member and said valve for providing fluid communication between said source and said first and second surfaces of said valve to substantially balance the axial fluid pressure o said valve when said valve is in said open position whereby said valve can begin to close under the effect of said permanent magnet.

3. The apparatus of claim 1 including means for reclosing said control valve, a low pressure outlet and a chamber communicating with the low pressure outlet when the control valve is in the closed position; said control valve being effective upon motion toward its open position to seal said chamber from the low pressure outlet thereby forming a sealed chamber of air to be compressed by further motion of the control valve towards its open position;

whereby said chamber functions as an air return spring for the control valve.

4. The apparatus of claim 1 wherein said valve and said member are coaxial;

said valve having an axial bore;

said member extending through said bore and said abutment being diametrically larger than said bore.

5. The apparatus of claim 4 wherein said valve carries an armature;

said latching means permanent magnet mounted in said housing for engagement with said armature to latch said armature and said valve in a closed position.

6. The apparatus of claim 5 wherein said electromagnetic means comprises a coil wound around said permanent magnet.

7. The apparatus of claim 1 wherein said abutment carries a resilient valve engaging surface.

8. A bistable electronically controlled fluid powered power valve actuator for use in an internal combustion engine of the type having engine intake and exhaust valves with elongated valve stems;

said actuator comprising a valve stem reciprocative along an axis between first and second positions in a housing corresponding to engine valve open and closed positions;

a power piston attached intermediately of said valve stem and reciprocative along said axis in a cylinder;

a pneumatic pressure source;

a pair of control valves reciprocative along said axis in said housing between open and closed positions for controlling the pneumatic pressure from said source to said power piston to move said power piston and said stem to said first and second positions;

magnetic latching means for closing and holding said control valves in their respective closed positions;

said stem first and second axial ends each carrying an abutment for abutting a respective said control valve to urge said control valves towards their respective closed positions during travel of said stem towards said first and second positions respectively thereby damping the motion of said stem and providing impetus to said control valves towards said closed positions.

9. The apparatus of claim 8 having first porting means in said housing cooperative with said piston and said control valves for providing fluid communication between said source and first and second surfaces of said valves to substantially balance the axial fluid pressure on said valves when said valves are in their respective said open positions whereby said valves are moved towards their closed positions solely under the effect of their respective said latching means.

10. The apparatus of claim 9 including second porting means in said housing cooperative with said piston and one of said valves for providing fluid communication between said source and one side of said piston to move said piston axially as said one valve is moving between said closed and open positions.

11. The apparatus of claim 8 wherein said valves and said stem are coaxial;

each of said valves having an axial bore;

said stem extending through said bores and said abutments being diametrically larger than their respective bores.

12. The apparatus of claim 11 wherein each of said valves carries an armature;

said latching means being mounted in said housing for engagement with said armatures to latch said armatures and their respective valves in a closed position.

13. The apparatus of claim 12 wherein said latching means comprises a permanent magnet and electromagnetic means comprising a coil wound around said permanent magne for each of said valves.

14. The apparatus of claim 8 wherein each said abutment carries a resilient valve engaging surface.

15. A bistable electronically controlled fluid powered transducer with a first member having a member driving side reciprocative in a housing along an axis between first and second positions;

a control valve reciprocative in said housing between open and closed positions;

latching means for closing and holding said valve in its closed position;

fluid pressure source for providing fluid pressure to said valve to move said valve towards said open valve position against the holding force of said latching means;

each of said member and said valve having first and second opposite ends;

said member first end carrying a valve end engaging abutment for abutting said valve first end to urge said valve towards said closed position during travel of said member towards said first position thereby damping the motion of said first member and providing impetus to said valve towards said closed position.

16. The apparatus of claim 15 including first porting means in said housing cooperative with said first member and said valve for providing fluid communication between said source and one side of said first member to move said first member axially as said valve is moving between said closed and open positions;

second porting means in said housing cooperative with said first member and said valve for providing fluid communication between said source and first and second surfaces of said valve to substantially balance the fluid pressure on said valve when said valve is in said open position whereby said valve can begin to close under the effect of said latching means.

17. A bistable electronically controlled fluid powered power valve actuator for use in an internal combustion engine of the type having engine intake and exhaust valves with elongated valve stems;

said actuator having a first member reciprocative along an axis between first and second positions in a housing corresponding to engine valve open and closed positions;

a power piston attached to said first member and reciprocative along said axis;

a pneumatic pressure source;

a control valve reciprocative along said axis between open and closed positions for controlling the pneumatic pressure from said source to said power piston to move said power piston and said member to said first and second positions;

latching means for holding said control valve in its closed position;

said member having first and second axial ends; said first axial end carrying a valve end engaging abutment for abutting said control valve to urge said control valve towards said closed position during travel of said member towards said first position thereby damping the motion of said first member and providing impetus to said control valve towards said closed position;

first porting means in said housing cooperative with said piston and said valve for providing fluid communication between said source and one side of said piston to move said piston axially as said valve is moving between said closed and open positions;

second porting means in said housing cooperative with said piston and said control valve for providing fluid communication between said source and first and second surfaces of said valve to substantially balance the axial fluid pressure on said valve when said valve is in its open position whereby said valve is moved toward its closed position solely under the effect of said latching means.

18. A pneumatically powered valve actuator comprising a valve actuator housing;

a piston reciprocative within the housing along an axis;

said piston having a pair of oppositely facing primary working surfaces;

a pressurized air source;

a pair of air control valves reciprocative along said axis relative to both the housing and the piston between open and closed positions;

means for selectively opening said air control valves to supply pressurized air from said air source to a respective one of said primary working surfaces causing the piston to move;

means for reclosing said air control valves including a low pressure air outlet and a chamber communicating with the low pressure air outlet when the air control valve is in the closed position;

said air control valves being effective upon motion toward their respective open positions to seal their respective chambers from the low pressure outlet thereby forming respective sealed chambers of air to be compressed by further motion of the air control valves toward their respective open positions.

19. The apparatus of claim 18 wherein said chambers function as an air return spring for their respective air control valves;

control valve motion away from their respective closed positions causing the respective chamber size to diminish linearly relative to said motion and the chamber pressure to increase approximately linearly relative to said motion with further control valve motion thereby providing a restorative force to the respective control valve which increases as the valve opens.

20. A fluid powered transducer comprising an housing;

a member reciprocative within the housing along an axis;

said member having a primary working surface for receiving fluid pressure to move said member along said axis;

a fluid pressure source;

an air control valve reciprocative relative to both the housing and the piston between open and closed positions;

means for selectively opening said air control valve to supply pressurized fluid from said source to said primary working surface causing said member to move;

means for reclosing said air control valve including a low pressure air outlet and a chamber communicating with the low pressure air outlet when the air control valve is in the closed position;

said air control valve being effective upon motion toward its open position to seal said chamber from the low pressure outlet thereby forming a sealed chamber of air to be compressed by further motion of the air control valve toward its open position.

21. The apparatus of claim 20 wherein said chamber functions as an air return spring for said air control valve;

control valve motion away from its closed position causing the chamber size to diminish linearly relative to said motion and the chamber pressure to increase approximately linearly relative to said motion with further control valve motion thereby providing a restorative force to the control valve which increases as the valve opens.

22. A pneumatically powered valve actuator comprising a valve actuator housing;

a piston reciprocative within the housing along an axis;

said piston having a pair of oppositely facing primary working surfaces;

a pressurized air source;

a pair of air control valves reciprocative along said axis relative to both the housing and the piston between open and closed positions;

means for selectively opening said air control valves to supply pressurized air from said air source to a respective one of said primary working surfaces causing the piston to move;

means for reclosing said air control valves including a low pressure air outlet and a chamber communicating with the low pressure air outlet when the air control valve is in the closed position;

said air control valves being effective upon motion toward their respective open positions to seal their respective chambers from the low pressure outlet thereby forming respective sealed chambers of air to be compressed by further motion of the air control valves toward their respective open positions;

said actuator comprising a valve stem reciprocative along an axis between first and second positions in a housing corresponding to engine valve open and closed positions;

said piston attached intermediately of said valve stem and reciprocative along said axis in a cylinder;

said control valves for controlling the pneumatic pressure to said piston to move said piston and said stem to said first and second positions;

latching means for closing and holding said control valves in their respective closed positions;

said air pressure source for providing fluid pressure to said control valves to move said control valves to their said open positions against the holding force of said latching means;

said stem first and second axial ends each carrying an abutment for abutting a respective said control valve to urge said control valves towards their respective closed positions during travel of said stem towards said first and second positions respectively thereby damping the motion of said stem and providing impetus to said control valves towards said closed positions.

23. The apparatus of claim 22 wherein said chambers function as an air return spring for their respective air control valves;

control valve motion away from their respective closed positions causing the respective chamber size to diminish linearly relative to said motion and the chamber pressure to increase approximately linearly relative to said motion with further control valve motion thereby providing a restorative force to the respective control valve which increases as the valve opens.

* * * * *

UNITED STATES PATENT AND TRADEMARK OFFICE

CERTIFICATE OF CORRECTION

PATENT NO. : 4,875,441

DATED : October 24, 1989

INVENTOR(S) : William E. Richeson and Frederick L. Erickson

It is certified that error appears in the above-identified patent and that said Letters Patent is hereby corrected as shown below:

Claim 1, column 10, line 17, cancel "in said one direction" and substitute --toward said one position--.

Claim 2, column 10, line 38, cancel "o" and substitute --to--.

Signed and Sealed this

Twenty-fifth Day of June, 1991

*Attest:*

*Attesting Officer*

HARRY F. MANBECK, JR.

*Commissioner of Patents and Trademarks*